US009441410B1

(12) United States Patent
Zorzi et al.

(10) Patent No.: US 9,441,410 B1
(45) Date of Patent: Sep. 13, 2016

(54) OPENING SYSTEM FOR A BUILDING WALL USING LATCHING ASSEMBLIES WITH AXIALLY OFFSET LATCH MECHANISMS

(71) Applicants: Andrea Zorzi, San Biagio Di Callalta (IT); Claudio Zorzi, San Biagio Di Callalta (IT)

(72) Inventors: Andrea Zorzi, San Biagio Di Callalta (IT); Claudio Zorzi, San Biagio Di Callalta (IT)

( * ) Notice: Subject to any disclaimer, the term of this patent is extended or adjusted under 35 U.S.C. 154(b) by 0 days.

(21) Appl. No.: 14/663,325

(22) Filed: Mar. 19, 2015

(51) Int. Cl.

| | |
|---|---|
| ***E06B 1/52*** | (2006.01) |
| ***E06B 3/36*** | (2006.01) |
| ***E05C 1/00*** | (2006.01) |
| ***E05C 1/10*** | (2006.01) |
| ***E05C 7/04*** | (2006.01) |
| ***E06B 1/36*** | (2006.01) |

(52) U.S. Cl.
CPC ..... *E06B 1/524* (2013.01); *E05C 1/004* (2013.01); *E05C 1/10* (2013.01); *E05C 7/045* (2013.01); *E06B 1/366* (2013.01); *E06B 1/52* (2013.01); *E06B 3/36* (2013.01)

(58) Field of Classification Search
CPC ..... E06B 1/52; E06B 1/524; E06B 1/366; E06B 3/36; E06B 3/26; E05C 1/004; Y10S 292/21
USPC ..... 49/365–369, 394; 292/32, 33
See application file for complete search history.

(56) References Cited

U.S. PATENT DOCUMENTS

| | | | | | |
|---|---|---|---|---|---|
| 140,064 | A | * | 6/1873 | Moffitt | E05F 11/00 292/238 |
| 1,439,332 | A | | 12/1922 | Schulte | |
| 1,473,117 | A | | 11/1923 | Meilink | |
| 1,502,982 | A | | 6/1924 | Dick | |
| 1,747,836 | A | | 2/1930 | Meilink | |
| 1,781,488 | A | | 11/1930 | Abbott | |
| 3,617,080 | A | | 11/1971 | Miller | |
| 4,204,369 | A | * | 5/1980 | Hubbard | E05B 65/1066 292/21 |
| 4,470,276 | A | | 9/1984 | Bayless | |
| 4,578,902 | A | * | 4/1986 | Niekrasz | A47F 3/043 49/382 |
| 4,644,696 | A | * | 2/1987 | Bursk | E06B 1/524 49/365 |
| 4,709,565 | A | | 12/1987 | Lin | |
| 4,741,277 | A | | 5/1988 | Salzer | |
| 5,060,582 | A | | 10/1991 | Salzer | |
| 5,471,792 | A | * | 12/1995 | Higgins | E06B 1/524 292/219 |
| 5,524,941 | A | | 6/1996 | Fleming | |
| 5,890,753 | A | | 4/1999 | Fuller | |
| 5,941,023 | A | * | 8/1999 | Mamchych | E06B 1/524 49/365 |
| 6,079,238 | A | | 6/2000 | Hoffmann et al. | |
| 7,404,306 | B2 | | 7/2008 | Walls et al. | |

(Continued)

*Primary Examiner* — Katherine Mitchell
*Assistant Examiner* — Marcus Menezes
(74) *Attorney, Agent, or Firm* — Glenn E. Gold, P.A.

(57) ABSTRACT

An opening system for a building wall includes a peripheral frame, a mullion, a pair of frameworks disposed in an empty space of the peripheral frame, a plurality of hinges swingable mounting the frameworks to the peripheral frame within the empty space, and a pair of latching assemblies. The latching assemblies having transversely-extending latch mechanisms that are disposed in respective ones of the frameworks and axially offset from one another so that one of latch mechanisms of one of the frameworks is latchably engageable with a portion of an adjacent one of the lateral sides of the mullion and the other one of the latch mechanisms of the other of the frameworks is latchably engageable with an adjacent portion of the one of the frameworks being located past the rear side of the mullion.

9 Claims, 12 Drawing Sheets

(56) References Cited

U.S. PATENT DOCUMENTS 7,878,034 B2 * 2/2011 Alber ..... E05C 7/06 292/142
8,136,300 B2 * 3/2012 Lin ..... E05B 63/242 292/219
8,393,115 B2 * 3/2013 Schroder ..... E06B 7/2305 49/469
8,459,704 B2 * 6/2013 Daniels ..... E05B 13/04 292/137
8,671,724 B2 3/2014 Uyeda
8,850,744 B2 * 10/2014 Bauman ..... E05C 9/1841 292/32

* cited by examiner

OPENING SYSTEM FOR A BUILDING WALL USING LATCHING ASSEMBLIES WITH AXIALLY OFFSET LATCH MECHANISMS

FIELD OF THE INVENTION

The present invention relates to latching assemblies and more particularly, is concerned with an opening system for a building wall using latching assemblies with axially offset latch mechanisms.

BACKGROUND OF THE INVENTION

Building wall opening systems, such as ones incorporating French doors and windows, traditionally have pairs of side-by-side opening structures that are hinged so as to swing inwardly or outwardly. French doors are used as both interior and exterior doors. They often link two rooms, such as adjacent living and dining rooms. They also commonly provide access to front entrances or entryways, balconies, patios and gardens.

However, some opening structures, such as exterior French doors and windows, raise security concerns due to less-than-adequate structural integrity. As a consequence, a vast majority of opening structures are highly vulnerable to in break-ins by ill-intentioned individuals, intrusion during high wind weather events, such as hurricanes, and the like. From the perspective of the inventor herein it appears to be the case that most of the uncertainty about the structural integrity of these opening structures derives from their latching assemblies, which utilize latch mechanisms that are axially aligned with one another.

Various approaches to reducing the aforementioned vulnerabilities of these opening structures are being sought to better secure their exterior use. However, there remains a need for a solution that will overcome the vulnerability of conventional structures.

SUMMARY OF THE INVENTION

The present invention relates to an innovation directed to overcoming this problem by providing an opening system for a building wall using latching assemblies with axially offset latch mechanisms. The axially offset latch mechanisms, compared to the conventional axially aligned latch mechanisms, provides more sites of structural resistance in the opening system due to the displaced positions of the latch mechanisms of the latching assemblies along an interface between components of opening structures of the system. This axially offset relationship of the latch mechanisms enhances the structural integrity of the opening system and should reduce its vulnerability to break-ins.

In one aspect, an opening system for a building wall includes:

a peripheral frame having opposite front and rear faces and defining an empty space bounded by the peripheral frame between opposite sides and between a top and a bottom of the peripheral frame and being open at the opposite front and rear faces of the peripheral frame;

a mullion having opposite front and rear sides and opposite lateral sides, the mullion front side being disposed proximate the peripheral frame front face and the mullion rear side being spaced forwardly from the peripheral frame rear face, the mullion extending upright between and interconnecting the top and bottom of the peripheral frame proximate the front face thereof, the mullion being spaced from the opposite sides of the peripheral frame so as to divide the empty space into a pair of empty sub-spaces adjacent to opposite lateral sides of the mullion;

a pair of frameworks each having opposite front and rear sides and being disposed in one of the empty sub-spaces adjacent to the opposite lateral sides of the mullion;

a plurality of hinges disposed at the rear face of the peripheral frame and the rear sides of the frameworks and connecting each of the frameworks to a respective one of the opposite sides of the peripheral frame at the rear face thereof so that the frameworks can undergo swinging movement toward and away from closed positions within the respective empty sub-spaces and adjacent to the opposite lateral sides of the mullion; and a pair of latching assemblies each installed in a respective one of the frameworks proximate one another and adjacent to the opposite lateral sides of the mullion such that each of the latching assemblies extends in the respective one of the frameworks from proximate the front sides of the frameworks and adjacent to the front side, along the opposite lateral sides, and past the opposite rear side of the mullion and toward the rear sides of the frameworks, the latching assemblies having transverse-extending latch mechanisms that are disposed in respective ones of the frameworks and axially offset from one another so that one of the latch mechanisms of one of the frameworks is latchably engageable with a portion of an adjacent one of the lateral sides of the mullion and the other of the latch mechanisms of the other of the frameworks is latchable engageable with an adjacent portion of the one of the frameworks being located past the rear side of the mullion.

In another aspect, an opening system for a building wall includes:

a peripheral frame having opposite front and rear faces and defining an empty space bounded by the peripheral frame between opposite sides and between a top and a bottom of the peripheral frame and being open at the opposite front and rear faces of the peripheral frame;

a pair of frameworks each having opposite front and rear sides and being disposed in side-by-side relationship to one another in a pair of side-by-side empty sub-spaces of the empty space of the peripheral frame;

a plurality of hinges disposed at the rear face of the peripheral frame and the rear sides of the frameworks and connecting each of the frameworks to a respective one of the opposite sides of the peripheral frame at the rear face thereof so that the frameworks can undergo swinging movement toward and away from side-by-side closed positions within the respective empty sub-spaces adjacent to one another; and a pair of latching assemblies each installed in a respective one of the frameworks proximate one another such that each of the latching assemblies extends in the respective one of the frameworks from proximate the front side of the framework toward the rear side of the framework, the latching assemblies having transverse-extending latch mechanisms that are disposed in the respective ones of the frameworks and axially offset from one another so as to be latchably engageable with different portions of respective others of the frameworks.

In still another aspect, an opening system for a building wall includes:

a peripheral frame having opposite front and rear faces, the peripheral frame comprising spaced apart opposite side frame members and spaced apart top and bottom frame members extending between and rigidly interconnected at opposite ends with opposite ends of the opposite side frame members so as to define an empty space bounded width-wise and height-wise respectively by the opposite side frame members and the top and bottom frame members of the peripheral frame and being open at the opposite front and rear faces of the peripheral frame;

a framework having opposite front and rear sides and being disposed in the empty space of the peripheral frame, the framework comprising spaced apart opposite side framework members and spaced apart top and bottom framework members extending between and rigidly interconnected at opposite ends with opposite ends of the opposite side framework members such that the top and bottom framework members of the framework are adjacent to and extend along corresponding ones of the top and bottom frame members of the peripheral frame and the opposite side framework members of the framework are adjacent to and extend along corresponding ones of the opposite side frame members of the peripheral frame;

a plurality of hinges disposed at the rear face of the peripheral frame and the rear side of the framework and connecting a respective one of the opposite side framework members of the framework to a corresponding one of the opposite side frame members of the peripheral frame so that the framework can undergo swinging movement toward and away from a closed position within the respective empty space of the peripheral frame; and a latching assembly installed in a respective other of the opposite side framework members of the framework such that the latching assembly extends in the other of the side framework members from proximate the front side of the framework toward the rear side of the framework, the latching assembly having a transversely-extending latch mechanism that is disposed in a respective other of the side framework members of the framework and axially movable so as to be latchably engageable with a portion of a corresponding other of the opposite side frame members of the peripheral frame.

These and other aspects, features, and advantages of the present invention will become more readily apparent from the attached drawings and the detailed description of the preferred embodiments, which follow.

BRIEF DESCRIPTION OF THE DRAWINGS

The preferred exemplary implementations of the invention will hereinafter be described in conjunction with the appended drawings, provided to illustrate, and not to limit, the invention, in which.

Like reference numerals refer to like parts throughout the several views of the drawings.

DETAILED DESCRIPTION OF PREFERRED IMPLEMENTATIONS

Figure 1:
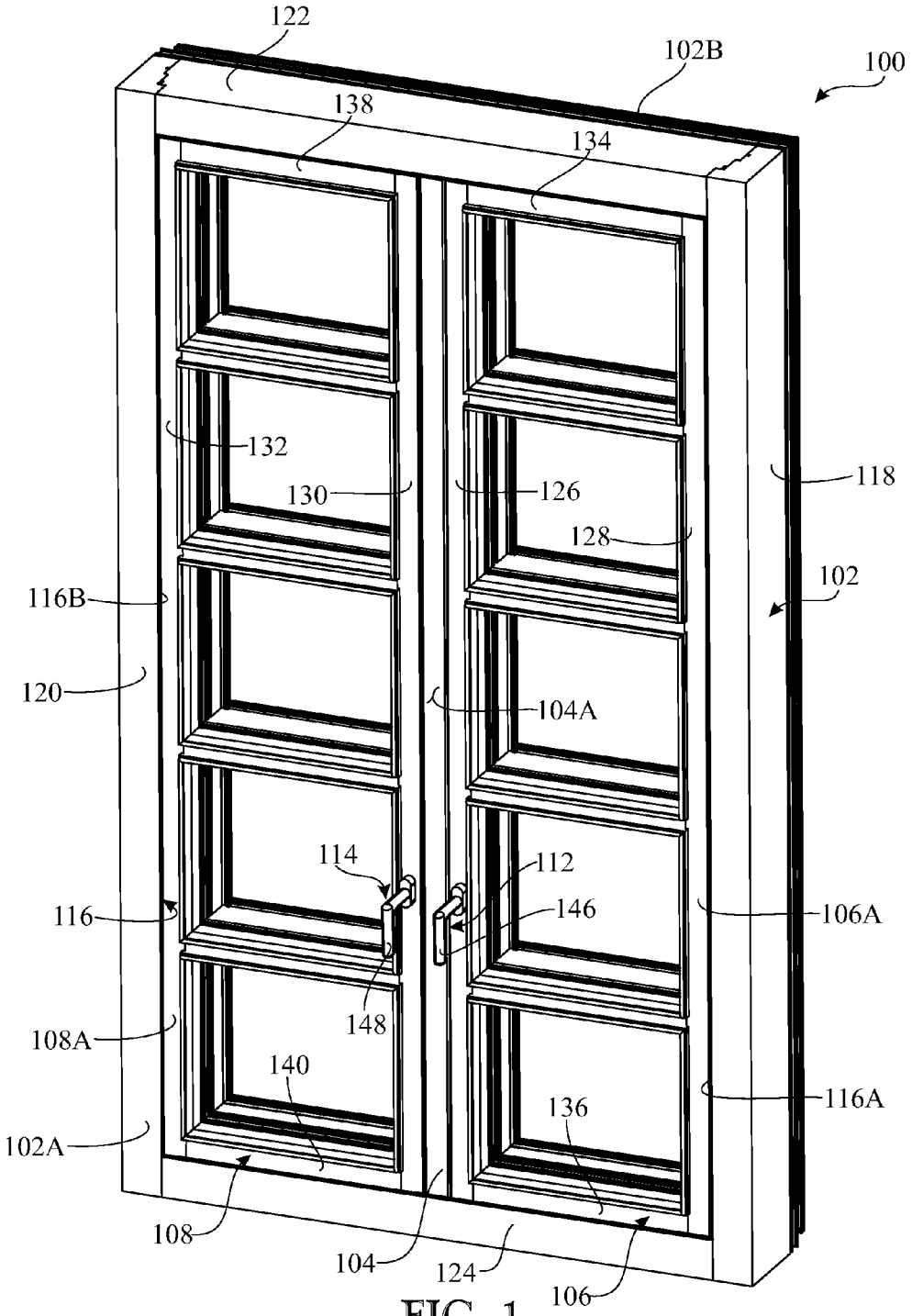
FIG. 1 presents a front isometric view of a first exemplary embodiment of an opening system for a building wall in accordance with an aspect of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-6, there is illustrated a first exemplary embodiment of an opening system, generally designated 100, for a building wall (not shown) in accordance with an aspect of the present invention. The opening system 100 includes a peripheral frame 102, a mullion 104, a pair of frameworks 106, 108, a plurality of hinges 110 and a pair of latching assemblies 112, 114. The peripheral frame 102 of the opening system 100 has opposite front and rear faces 102A, 102B. An empty space 116 in the opening system 100 is defined and bounded by the peripheral frame 102 between opposite sides and between a top and a bottom of the peripheral frame 102 and is open at the opposite front and rear faces 102A, 102B of the peripheral frame 102. The mullion 104 of the opening system 100 has opposite front and rear sides 104A, 104B and opposite lateral sides 104C, 104D. The front side 104A of the mullion 104 is disposed proximate the front face 102A of the peripheral frame 102. The rear side 104B of the mullion 104 is spaced forwardly from the rear face 102B of the peripheral frame 102. The mullion 104 extends upright between and interconnects with top and bottom of the peripheral frame 102 proximate the front face 102A thereof and is spaced from the rear face 102B thereof.

More particularly, the opposite sides of the peripheral frame 102 are defined by spaced apart opposite side frame members 118, 120. The top and bottom of the peripheral frame 102 are defined by spaced apart top and bottom frame members 122, 124 extending between and rigidly interconnected at opposite ends with opposite ends of the opposite side frame members 118, 120. The interconnected opposite side, top and bottom frame members 118-124 together bound, and define the width and height of, the empty space 116. Furthermore, the mullion 104 extends upright between and interconnects with the top and bottom frame members 122, 124 of the peripheral frame 102 at mid-locations therealong and spaced (such as equally) from the opposite side frame members 118, 120. The presence of the mullion 104 divides the empty space 116 of the peripheral frame 102 into a pair of empty sub-spaces 116A, 116B adjacent to opposite lateral sides 104C, 104D of the mullion 104.

Each of the pair of frameworks 106, 108 of the opening system 100 is disposed in one of the empty sub-spaces 116A, 116B within the peripheral frame 102 and adjacent to the opposite lateral sides 104C, 104D of the mullion 104. Each of the frameworks 106 and 108 has opposite front and rear sides 106A, 106B and 108A, 108B. Also, each of the frameworks 106 and 108 respectively includes a pair of spaced apart inner and outer side framework members 126, 128 and 130, 132 and a pair of spaced apart top and bottom framework members 134, 136 and 138, 140 extending between and rigidly interconnected at opposite ends with opposite ends of the inner and outer side framework members 126, 128 and 130, 132. Thus, the top and bottom framework members 134, 136 and 138, 140 of the frameworks 106 and 108 are disposed in the empty sub-spaces 116A, 116B adjacent to and extending along the respective ones of the top and bottom frame members 122, 124 of the peripheral frame 102. The inner and outer side framework members 126, 128 and 130, 132 of the frameworks 106, 108 are disposed in the empty sub-spaces 116A, 116B adjacent to and extending along the respective ones of the opposite lateral sides 104C, 104D of the mullion 104 and respective ones of the opposite side frame members 118, 120 of the peripheral frame 102. By way of example, the pair of frameworks 106, 108 may be a pair of sashes forming a French door or window, with the inner and outer side framework members 126, 128 and 130, 132 being stiles of the sashes and the top and bottom framework members 134, 136 and 138, 140 being rails of the sashes.

Figure 2:
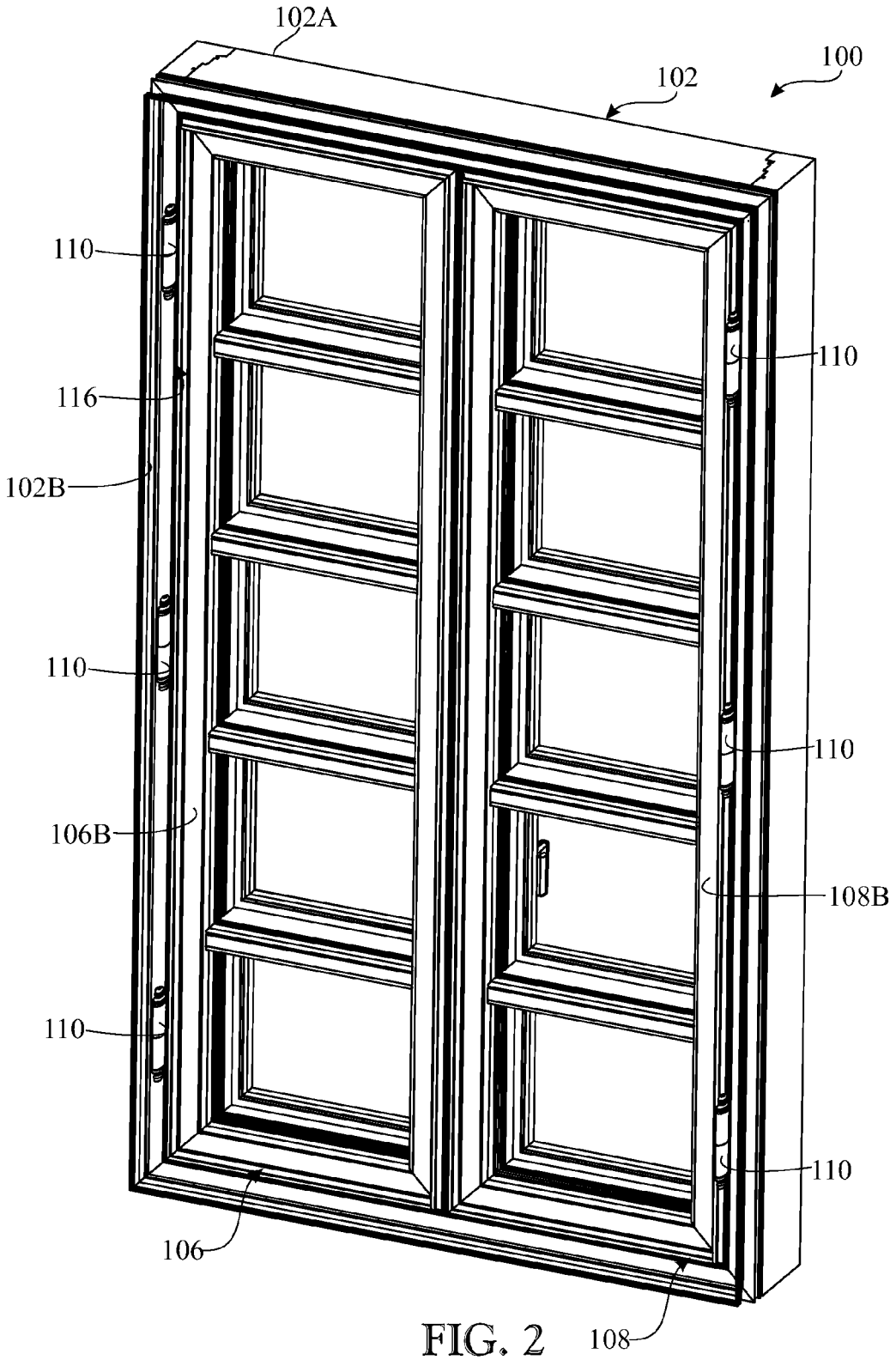
FIG. 2 presents a rear isometric view of the opening system originally introduced in FIG. 1.
Figure 3:
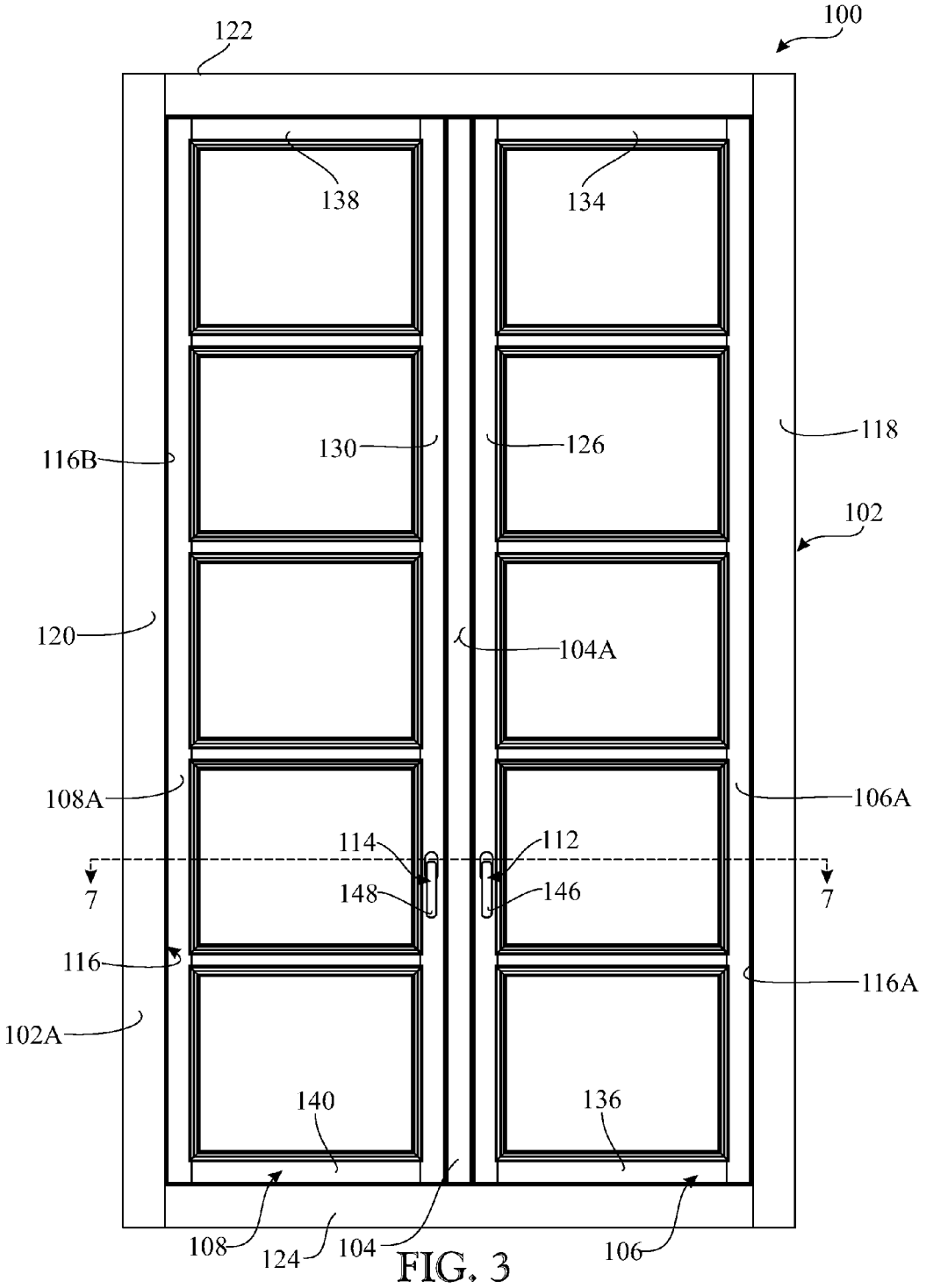
FIG. 3 presents a front elevation view of the opening system originally introduced in FIG. 1.
Figure 4:
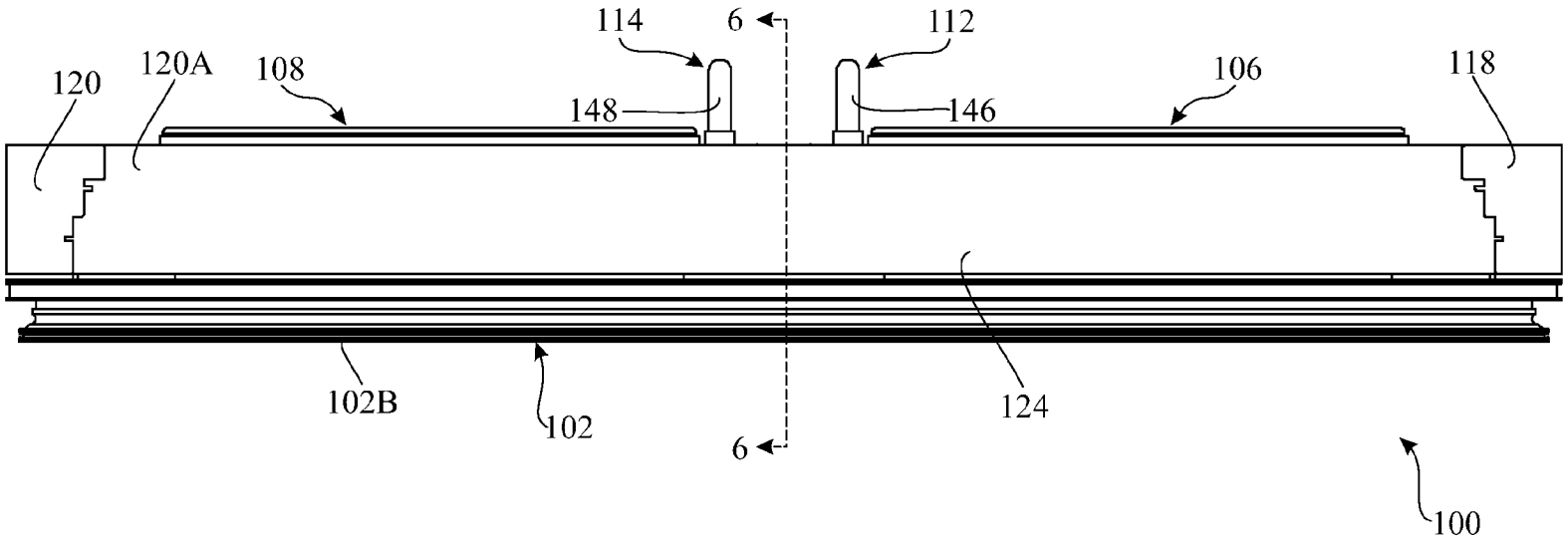
FIG. 4 presents a bottom view of the opening system originally introduced in FIG. 1.
Figure 5:
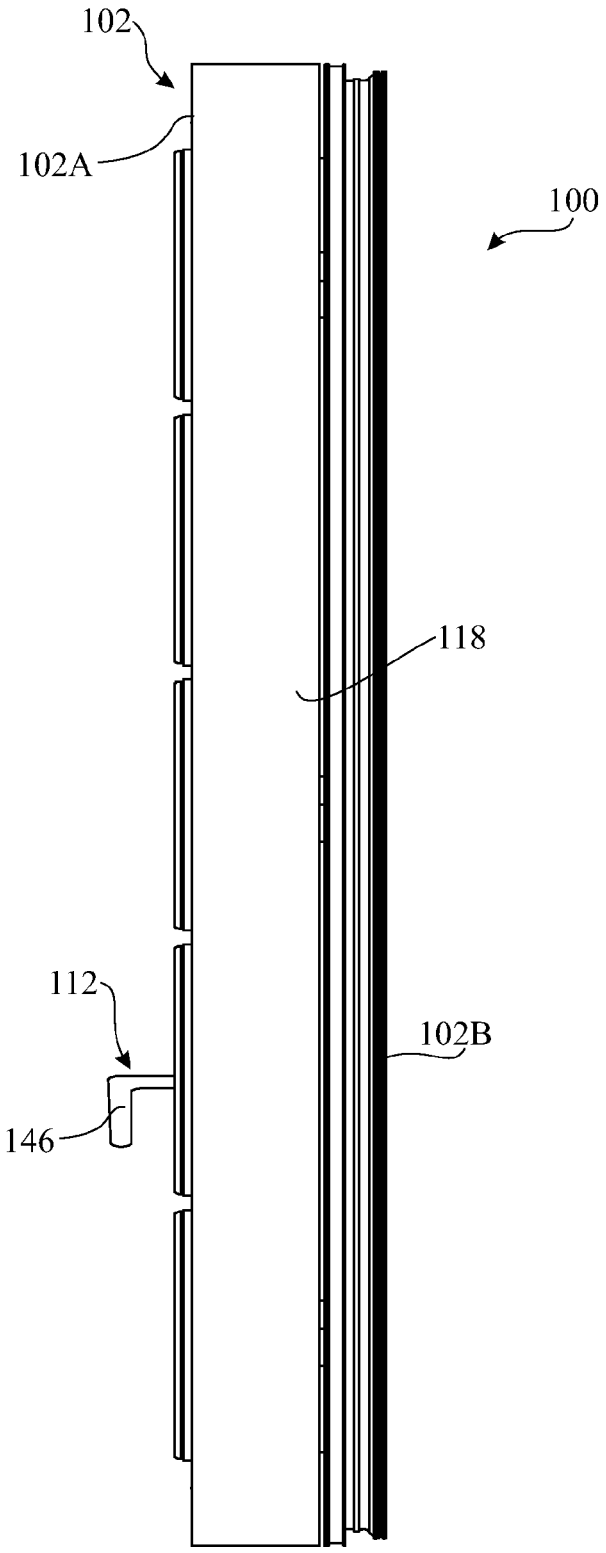
FIG. 5 presents a right side elevation view of the opening system originally introduced in FIG. 1.
Figure 6:
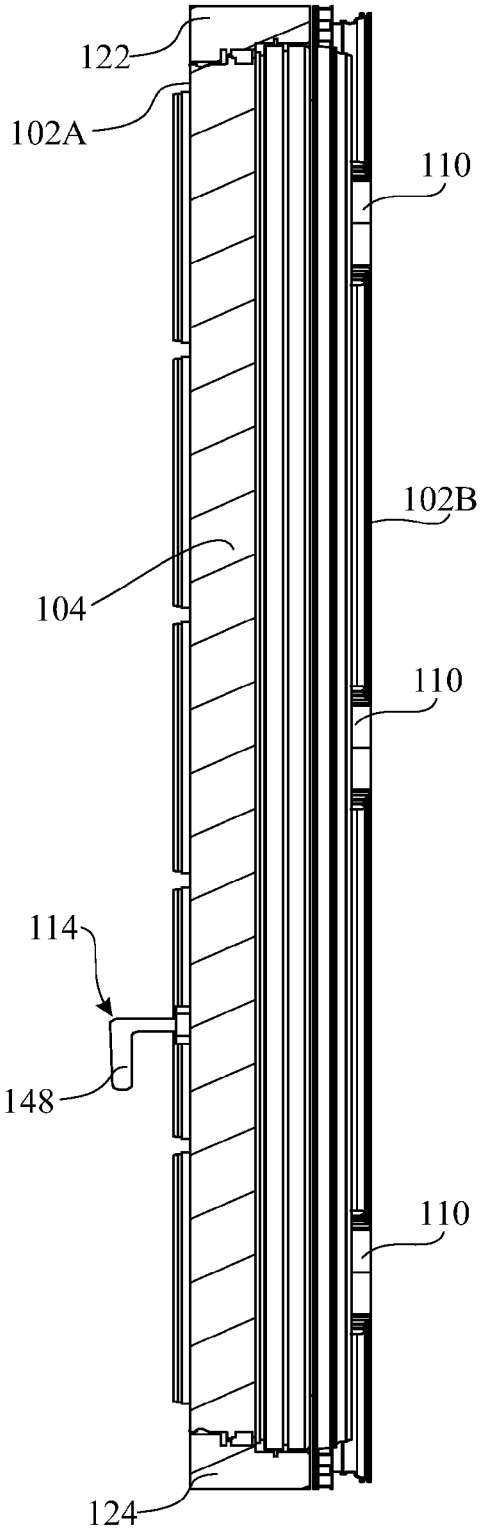
FIG. 6 presents a longitudinal sectional view of the opening system taken along section line 6-6 in FIG. 4.
Figure 7:
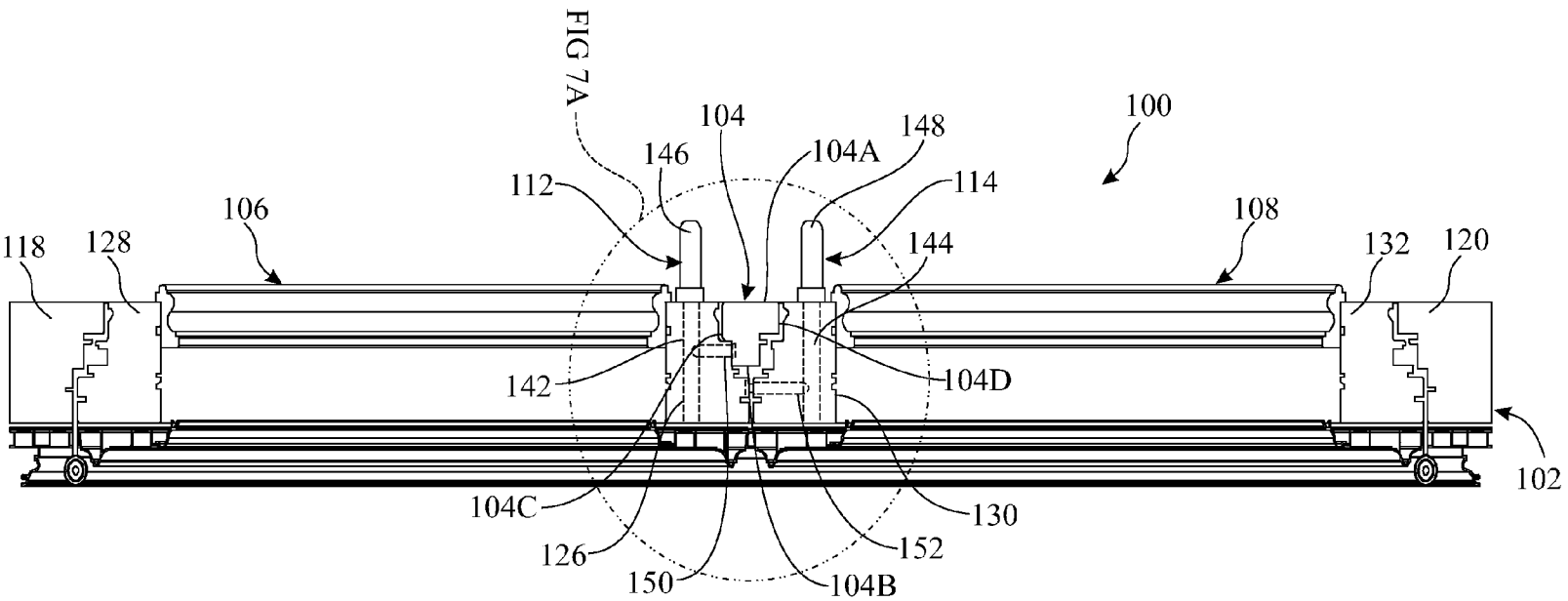
FIG. 7 presents an enlarged transverse sectional view of the opening system taken along section line 7-7 in FIG. 3.
Figure 7A:
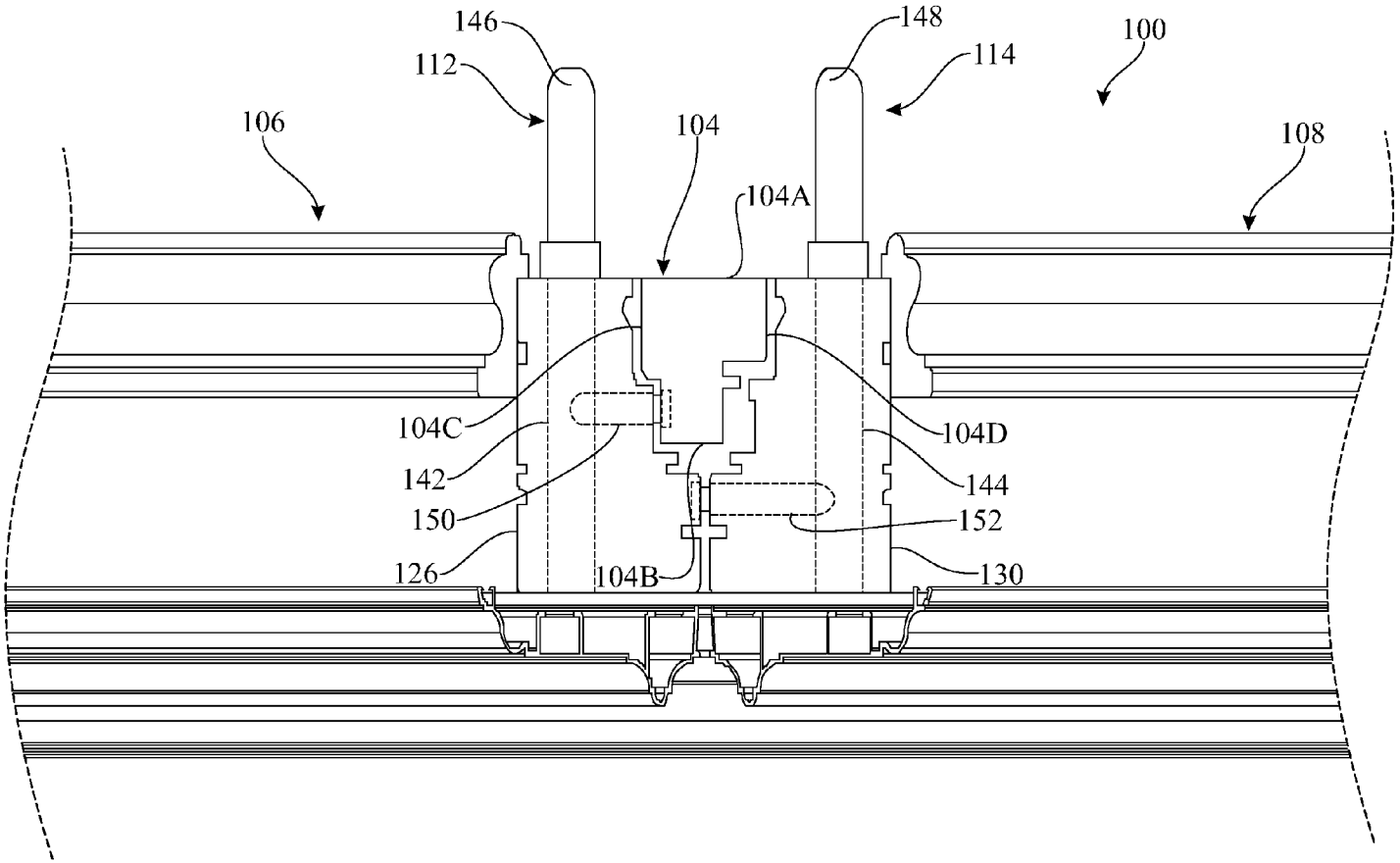
FIG. 7A presents an enlarged view of the portion of the opening system within the dashed circle in FIG. 7.

As best seen in FIGS. 2, 6 and 7, the plurality of hinges 110 of the opening system 100 are disposed at the rear face 102B of the peripheral frame 102 and the rear sides 106B and 108B of the frameworks 106, 108. The hinges 110 connect the outer side framework members 128, 132 of the respective frameworks 106, 108 to corresponding ones of the opposite side frame members 118, 120 of the peripheral frame 102. The hinges 110 thusly enable the respective frameworks 106, 108 to undergo swinging movement toward and away from the closed positions, as seen in FIGS. 1-6, within the respective empty sub-spaces 116A, 116B and adjacent to opposite lateral sides 104C, 104D of the mullion 104.

As best seen in FIGS. 1, 3, 4-7 and 7A, each of the pair of latching assemblies 112, 114 of the opening system 100 is installed in a respective one of the inner side framework members 126, 130 of the pair of frameworks 106, 108 proximate to one another between and equidistant from the top and bottom framework members 134, 136 and 138, 140 of the pair of frameworks 106, 108. Further, each of the pair of latching assemblies 112, 114 extends through the respective one of the inner side framework members 126, 130 of the pair of frameworks 106, 108 from proximate the front side 106A, 108A and toward the rear side 106B, 108B thereof and is disposed adjacent to the front side 104A, along a respective one of the opposite lateral sides 104C, 104D, and past the opposite rear side 104B of the mullion 104. More particularly, each of the pair of latching assemblies 112, 114 includes a spindle 142, 144, a handle 146, 148 and a latch mechanism 150, 152. The respective elongated spindles 142, 144 of the pair of latching assemblies 112, 114 are spaced apart and disposed in a parallel relationship to one another in respective ones of the inner side framework members 126, 130 of the pair of frameworks 106, 108 and extend from proximate the front sides 106A, 108A of the pair of frameworks 106, 108 and adjacent to the front side 104A, along the opposite lateral sides 104C, 104D, and past the opposite rear side 104B, of the mullion 104, toward the rear sides 106B, 108B of the pair of frameworks 106, 108. The respective handles 146, 148 of the pair of latching assemblies 112, 114 are attached to front ends of respective ones of the spindles 142, 144 and disposed outwardly of and proximate to the front side 106A, 108A of the pair of the frameworks 106, 108 and are accessible to a user in front of the front side 106A, 108A of the pair of the frameworks 106, 108. The respective latch mechanisms 150, 152 of the pair of latching assemblies 112, 114 are spaced apart and disposed in parallel relationship to one another in respective ones of the inner side framework members 126, 130 of the pair of frameworks 106, 108 and in respective transverse relationships to and coupled with respective ones of the spindles 142, 144. The latch mechanisms 150, 152 are also axially offset from one another along the respective parallel spindles 142, 144 so that a respective one of the latch mechanisms 150, 152 is latchably engageable with a portion of an adjacent one of the lateral sides 104C, 104D of the mullion 104 and a respective other of the latch mechanisms 150, 152 is latchably engageable with a portion of an adjacent one of the inner side framework members 126, 130 of the pair of frameworks 106, 108 being located past the rear side 104B of the mullion 104. Upon turning the respective handles 146, 148, the corresponding spindles 142, 144 turn and cause the corresponding one latch mechanism 150 in the one framework 106 to respectively latchably engage with the portion of the adjacent one lateral side 104C of the mullion 104 and the corresponding other latch mechanism 152 in the other framework 108 to respectively latchably engage with the adjacent portion of the one framework 106 being located past the rear side 104B of the mullion 104.

Figure 8:
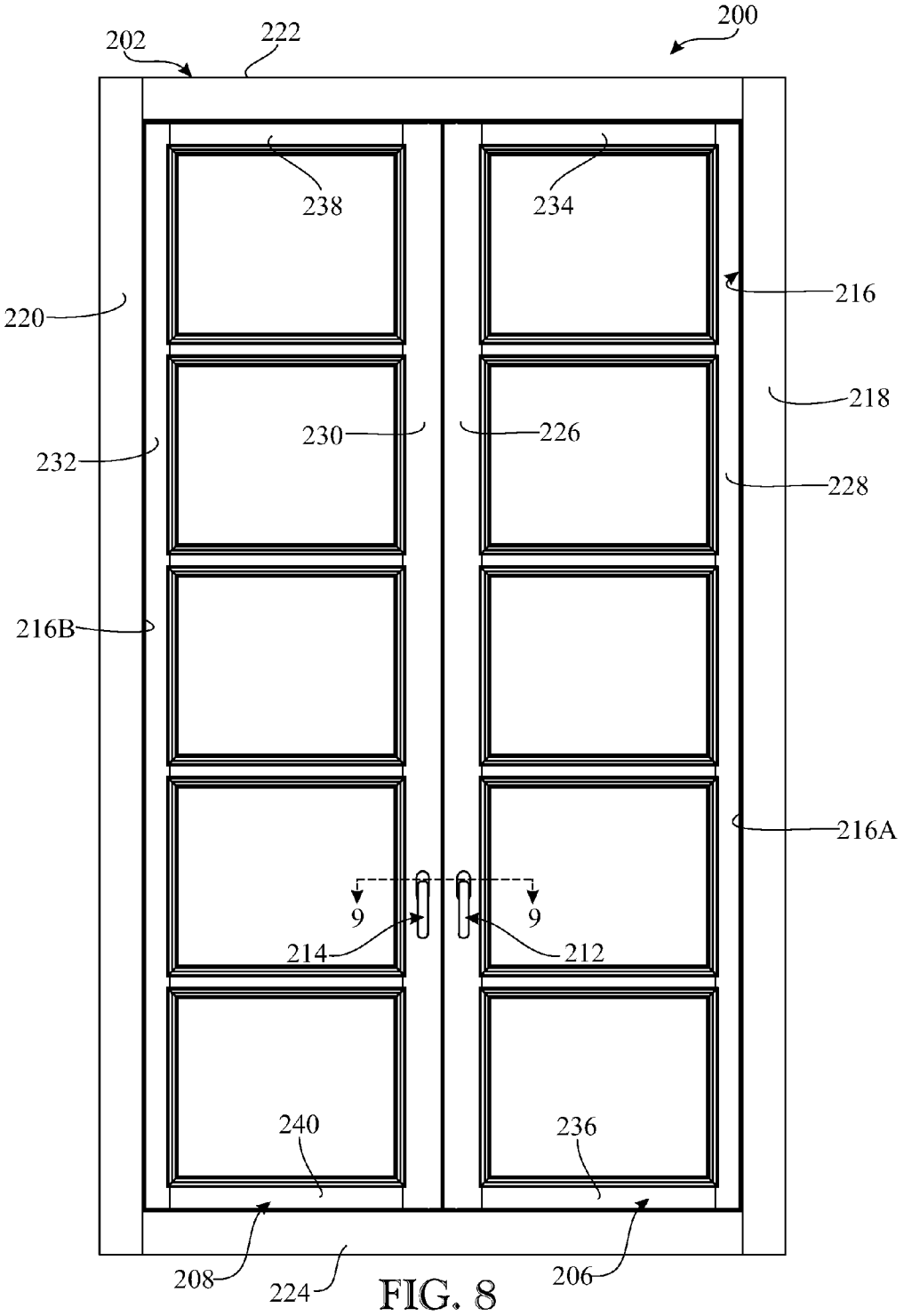
FIG. 8 presents a front elevation view of a second exemplary implementation of an opening system for a building wall in accordance with an aspect of the present invention.
Figure 9:
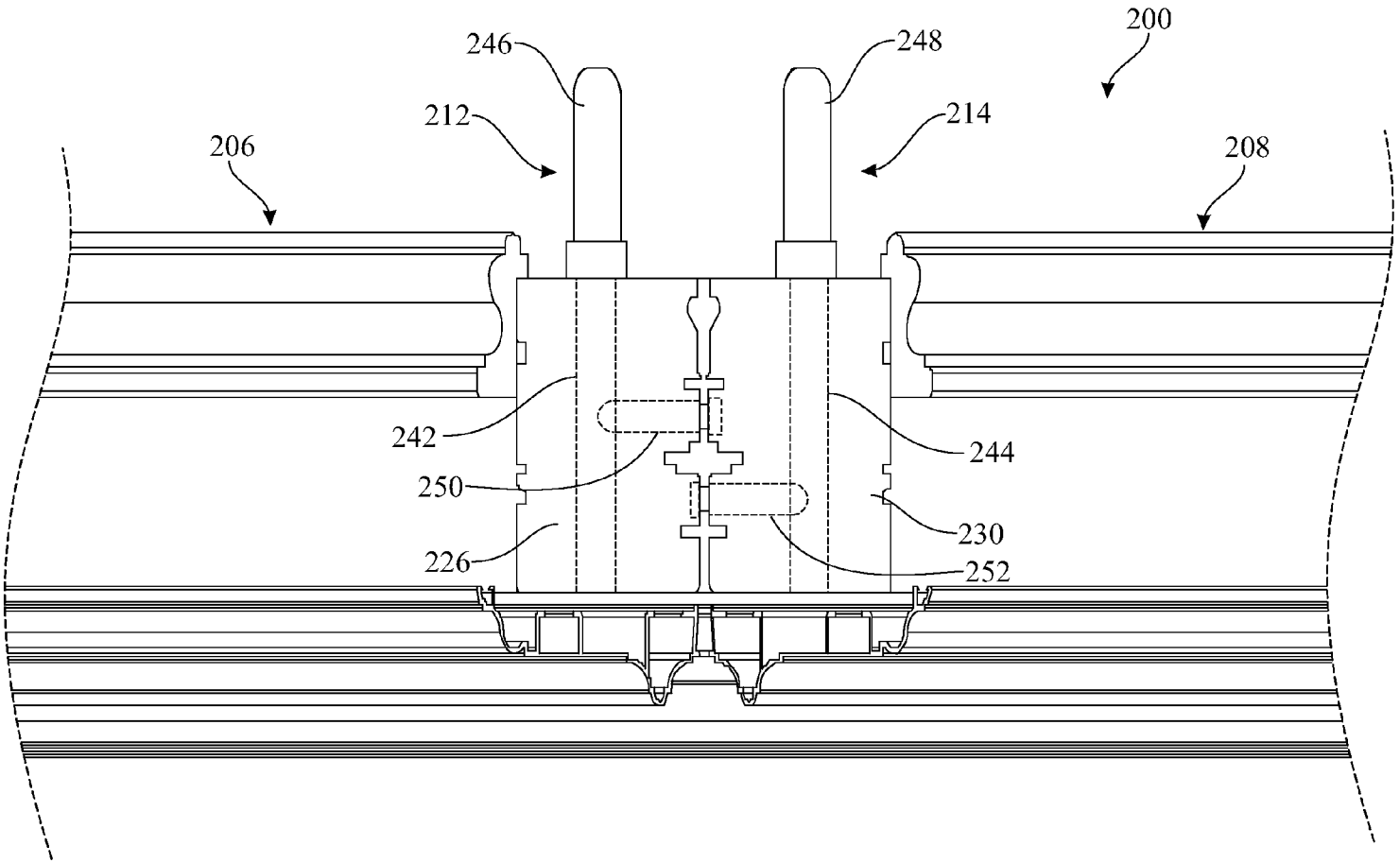
FIG. 9 presents an enlarged transverse sectional view of a portion of the opening system taken along section line 9-9 in FIG. 8.

Turning now to FIGS. 8 and 9, there is illustrated a second exemplary embodiment of an opening system, generally designated 200, for a building wall (not shown) in accordance with an aspect of the present invention. Like features of the opening system 200 and the opening system 100 are numbered the same except preceded by the numeral '2'. Reference may be made to the above description of the features of the opening system 100 for gaining an understanding of the like features of the opening system 200. Only the differences between the two opening systems will be described hereinafter. The opening system 200 does not employ the mullion 104 of the opening system 100. Thus, the pair of frameworks 206, 208 are disposed in side-by-side relationship to one another in the pair of side-by-side empty sub-spaces 216A, 216B of the peripheral frame 202. The latch mechanisms 250, 252 of the latching assemblies 212, 214 disposed in the respective ones of the frameworks 206, 208 are axially offset from one another so as to latchably engage with different portions of respective others of the frameworks 208, 206.

Figure 10:
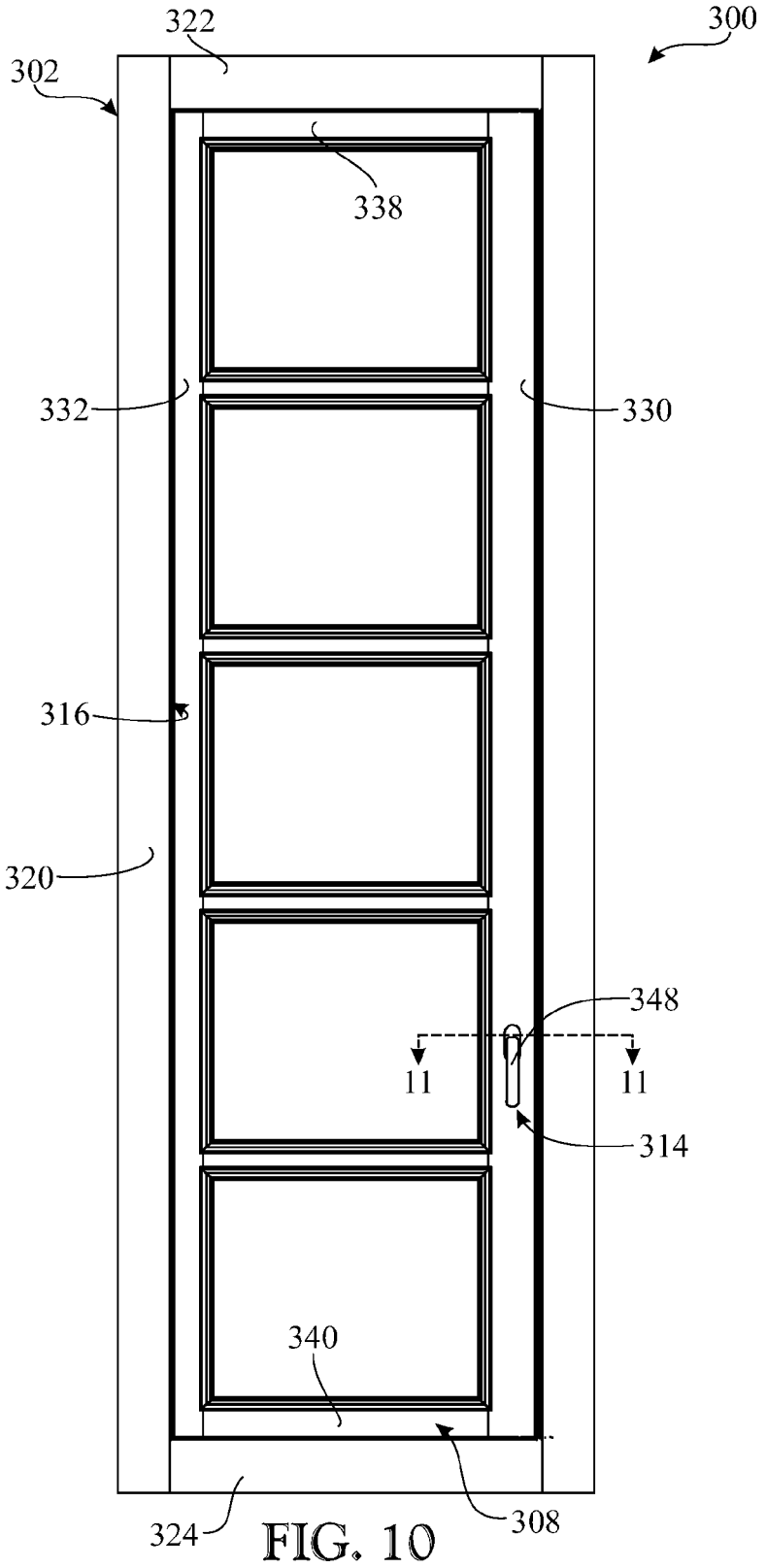
FIG. 10 presents a front elevation view of a third exemplary implementation of an opening system for a building wall in accordance with an aspect of the present invention.
Figure 11:
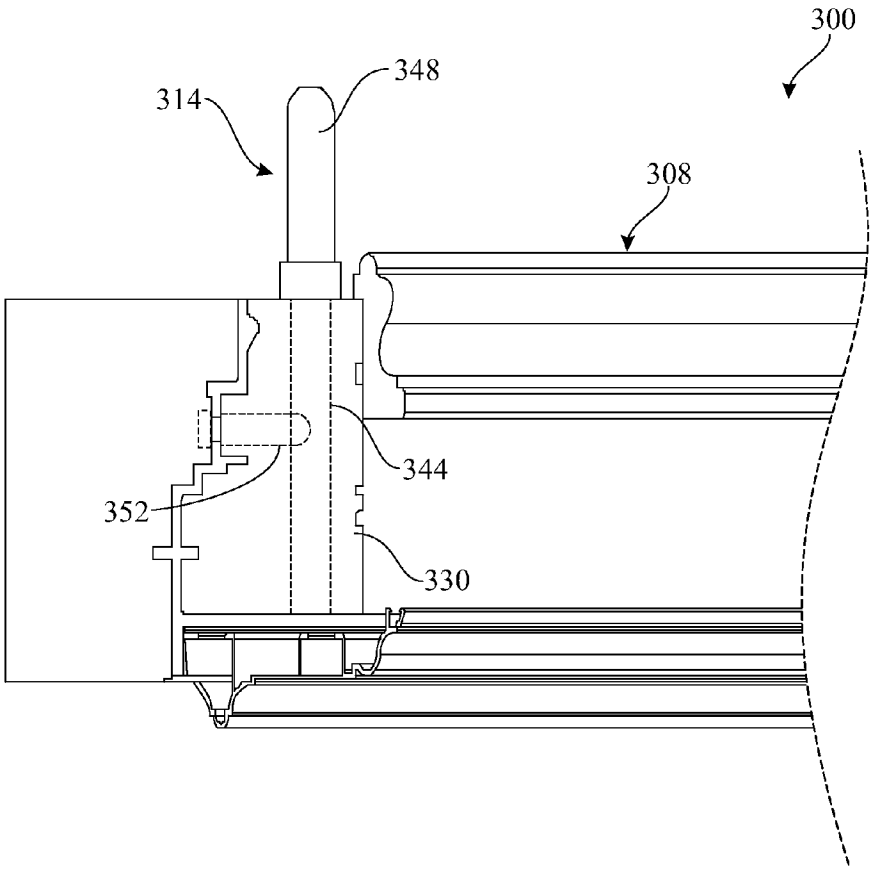
FIG. 11 presents an enlarged transverse sectional view of a portion of the opening system taken along section line 11-11 in FIG. 10.

Referring lastly to FIGS. 10 and 11, there is illustrated a third exemplary embodiment of an opening system, generally designated 300, for a building wall (not shown) in accordance with an aspect of the present invention. Like features of the opening system 300 and the opening systems 100 and 200 are numbered the same except preceded by the numeral '3'. Reference may be made to the above description of the features of the opening systems 100 and 200 for gaining an understanding of the like features of the opening system 300. Only the differences between the three opening systems will be described hereinafter. The opening system 300 does not employ the mullion 104 of the opening system 100 and only the left one-half of the opening system 200. Thus, only a framework 308 is disposed in the empty sub-space 316B in one-half of the peripheral frame 302. Also, the opening system 300 employs only one latching assembly 314 disposed in the one framework 308. Its latch mechanism 352 latchably engages with a portion of an adjacent one of the side frame members 318 of the peripheral frame 302.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An opening system for a building wall, comprising:

a peripheral frame having opposite front and rear faces and defining an empty space bounded by said peripheral frame between opposite sides and between a top and a bottom of said peripheral frame and being open at said opposite front and rear faces of said peripheral frame;

a mullion having opposite front and rear sides and opposite lateral sides, said mullion front side being disposed proximate to said peripheral frame front face and said mullion rear side being spaced forwardly from said peripheral frame rear face, said mullion extending upright, between, and interconnecting said top and bottom of said peripheral frame proximate said front face thereof, said mullion being spaced from said opposite sides of said peripheral frame so as to divide said empty space into a pair of empty sub-spaces adjacent to opposite lateral sides of said mullion;

a pair of frameworks each comprising opposite front and rear sides, spaced apart inner and outer side framework members disposed in a respective empty sub-space of said empty sub-spaces adjacent to and along one of said opposite lateral sides of said mullion and one of said opposite sides of said peripheral frame, and spaced apart top and bottom framework members disposed in said respective empty sub-space of said empty sub-spaces adjacent to and along one of said top and bottom of said peripheral frame and extending between one of said opposite sides of said peripheral frame and one of said opposite lateral sides of said mullion;

a plurality of hinges disposed at said rear face of said peripheral frame and rear sides of said frameworks and connecting each of said frameworks to one of said opposite sides of said peripheral frame at said rear face thereof so that said frameworks can undergo swinging movement toward and away from closed positions within said respective empty sub-spaces adjacent to said opposite lateral sides of said mullion; and a pair of latching assemblies each installed in a respective one of said inner side framework members of said pair of frameworks, said pair of latching assemblies being disposed proximate to one another between and equidistant from said top and bottom framework members of each of said pair of frameworks, and adjacent to one of said opposite lateral sides of said mullion such that each latching assembly extends through said respective one of said inner side framework members of said pair of frameworks from proximate said front sides and toward said rear sides of said frameworks and is disposed adjacent to said front side, along said opposite lateral sides, and past said opposite rear side of said mullion;

wherein each of said pair of latching assemblies comprises a spindle, each of said spindles of said pair of latching assemblies being spaced apart and disposed in parallel relationship with the other of the spindles, wherein each of said spindles extends in a respective inner side framework member of said pair of frameworks and extending from proximate said front sides of said pair of frameworks along a longitudinal axis, and along said opposite lateral sides and past said opposite rear side of said mullion, toward said rear sides of said pair of frameworks, a handle, each of said handles of said pair of latching assemblies being attached to a respective spindle and disposed outwardly of and proximate to said front sides of said pair of frameworks, and a latch mechanism, each of said latch mechanisms of said pair of latching assemblies being spaced apart and disposed in parallel relationship with the other of the latch mechanisms, wherein each of said latch mechanisms extends in a respective inner side framework member of said pair of frameworks and couples with a respective spindle such that by turning said handles, said spindles turn and said latch mechanisms move into engagement with one of said inner side framework members and one of said opposite lateral sides of said mullion, respectively; and also wherein said latch mechanisms of said pair of latching assemblies are axially offset from one another along the longitudinal axes of said parallel spindles so that one of said latch mechanisms of one of said pair of latching assemblies is latchably engageable with a portion of an adjacent one of said lateral sides of said mullion and the other of said latch mechanisms of the other of said pair of latching assemblies is latchably engageable with a portion of an adjacent one of said inner side framework members of said pair of frameworks being located past said rear side of said mullion.

2. The opening system of claim 1, wherein said opposite sides of said peripheral frame are defined by spaced apart opposite side frame members.

3. The opening system of claim 2, wherein said top and bottom of said peripheral frame are defined by spaced-apart top and bottom frame members extending between, and rigidly interconnected at opposite ends with, opposite ends of said opposite side frame members.

4. The opening system of claim 3, wherein said empty space of said peripheral frame is bounded width-wise and height-wise respectively by said opposite side frame members and said top and bottom frame members.

5. The opening system of claim 3, wherein said mullion extends upright between and is interconnected with said top and bottom frame members of said peripheral frame and is spaced from said opposite side frame members of said peripheral frame.

6. The opening system of claim 5, wherein said mullion interconnects with said top and bottom frame members of said peripheral frame such that said empty sub-spaces on opposite sides of said mullion are equal in size and configuration.

7. The opening system of claim 2, wherein said outer side framework member of each of said pair of frameworks is disposed along an opposite side frame member of said peripheral frame.

8. The opening system of claim 3, wherein said top and bottom framework members of each of said frameworks extend between and rigidly interconnect at opposite ends with opposite ends of said inner and outer side framework members of each of said frameworks such that said top and bottom framework members of said frameworks are disposed in respective empty sub-spaces adjacent to and along said top and bottom frame members, respectively, of said peripheral frame.

9. The opening system of claim 2, wherein said plurality of hinges connect each of said frameworks at said respective outer side framework member of one of said frameworks to one of said opposite sides frame members of said peripheral frame.

* * * * *